United States Patent [19]

Ehlscheid et al.

[11] Patent Number: 4,714,394

[45] Date of Patent: Dec. 22, 1987

[54] METHOD AND APPARTUS FOR DEPOSITING A PROPER NUMBER OF FLEXIBLE WORK PIECES IN A PROPER POSITION

[75] Inventors: Guenter Ehlscheid; Gilbert Hauschild, both of Neuwied, Fed. Rep. of Germany

[73] Assignee: Winkler & Duennebier Maschinenfabrik und Eisengieserei GmbH & Co. KG, Neuwied, Fed. Rep. of Germany

[21] Appl. No.: 834,111

[22] Filed: Feb. 24, 1986

Related U.S. Application Data

[63] Continuation-in-part of Ser. No. 719,709, Apr. 4, 1985, abandoned.

[30] Foreign Application Priority Data

Apr. 13, 1984 [DE] Fed. Rep. of Germany ..... 3413952

[51] Int. Cl.[4] ..... B65G 57/04

[52] U.S. Cl. ..... 414/41; 414/43; 414/52; 414/49; 414/73; 414/46; 414/901; 414/98; 198/421; 198/419; 198/424; 198/468.9; 271/306; 271/187; 271/218; 271/197

[58] Field of Search ..... 414/901, 46, 51, 53, 414/49, 81, 73, 786, 41, 43, 52, 98; 271/306, 307, 187, 184, 214, 215, 216, 217, 218, 197; 198/422, 419, 420, 468.9, 424

[56] References Cited

U.S. PATENT DOCUMENTS

| | | | |
|---|---|---|---|
| 2,205,767 | 6/1940 | Lamb | 271/215 |
| 3,390,508 | 7/1968 | Heimlicher | 414/31 X |
| 3,477,558 | 11/1969 | Fleischauer | 271/197 X |
| 3,531,108 | 9/1970 | Rabinow et al. . | |
| 3,693,486 | 9/1972 | Maniaci et al. | 198/448 |
| 3,729,188 | 4/1973 | Stephenson | 271/217 X |
| 3,805,971 | 4/1974 | Behrens et al. | 414/907 X |
| 3,851,773 | 12/1974 | Kluge et al. | 414/31 |
| 3,980,183 | 9/1976 | Anikanov et al. | 414/53 X |
| 4,367,997 | 1/1983 | Schweingruber | 414/46 X |
| 4,501,418 | 2/1985 | Ariga et al. | 271/187 |
| 4,523,671 | 6/1985 | Campbell | 414/51 X |

FOREIGN PATENT DOCUMENTS

| | | | |
|---|---|---|---|
| 919118 | 1/1973 | Canada | 198/420 |
| 2654636 | 6/1978 | Fed. Rep. of Germany | 271/187 |
| 3016987 | 4/1981 | Fed. Rep. of Germany . | |
| 3042519 | 5/1981 | Fed. Rep. of Germany . | |
| 623482 | 5/1949 | United Kingdom | 198/448 |
| 1341232 | 12/1973 | United Kingdom . | |
| 1429024 | 3/1976 | United Kingdom . | |
| 2085850 | 5/1982 | United Kingdom . | |

*Primary Examiner*—Frank E. Werner

*Attorney, Agent, or Firm*—W. G. Fasse; D. H. Kane, Jr.

[57] ABSTRACT

A proper number of flexible work pieces such as napkins, handkerchiefs and the like are deposited in a proper position or positions for providing packages each of which contains a freely selectable number of pieces. For this purpose the work pieces travel through at least one branching station and from there alternately into two depositors or stacking stations comprising several compartments. The depositors then deposit the work pieces on a stacking table from which the stacks are removed onto a conveyor belt for continuing the conveying, for example into a packaging machine. The branching station includes three suction drums in which the suction is controlled for alternately distributing work pieces into different directions to different stackers. Air permeable conveyor belts run around the suction drums.

6 Claims, 15 Drawing Figures

METHOD AND APPARTUS FOR DEPOSITING A PROPER NUMBER OF FLEXIBLE WORK PIECES IN A PROPER POSITION

CROSS-REFERENCE TO RELATED APPLICATION:

The present application is a continuation-in-part patent application of U.S. Ser. No. 719,709, filed on Apr. 4, 1985, now abandoned.

FIELD OF THE INVENTION

The invention relates to a method and apparatus for depositing a proper number of flexible work pieces, for example napkins, handkerchiefs, and the like, in a proper position or in proper positions. More specifically, the invention relates to a method and apparatus for forming stacks of work pieces whereby each stack contains a predetermined number of work pieces.

DESCRIPTION OF THE PRIOR ART

It is known in connection with paper machines to stack or deposit, for example folded napkins, handkerchiefs, or the like, on stacking tables with the aid of gripping or sucking rollers and to form a package containing the proper number of work pieces by moving a separation mechanism into a stack between the napkins or handkerchiefs. Each such separation must take place between work pieces arriving at high speed which leads to expensive constructions which are trouble prone to a certain extent, especially when high performance machines are involved. Thus, the depositing of a proper number of work pieces in a proper position may limit the machine performance.

It is further known, for example, from German Patent Publications (DE-OS) Nos. 3,016,987 or 3,042,519 to lead the work pieces coming out of a machine along different paths, to a common collector chain, by means of several corresponding distributors, whereupon the collector chain forms partial packages which are assembled to form the final package containing the proper number of items.

It is a disadvantage in this connection that only packages can be formed which contain a number of items corresponding to the respective multiple of partial packages. Thus, the selection of the number of pieces in a package is not very flexible. Further, the collector chain in these prior art devices must run at a high operational speed, which entails a corresponding high wear and tear.

It is known from U.S. Pat. No. 4,523,671 to divert flexible work pieces, such as diapers, from a single file formation into a multi file or column formation with the aid of vacuum heads reaching to the surface of a rotating drum. These vacuum heads are cam operated for a transverse sliding movement parallel to the rotational drum axis whereby the incoming single file of diapers is converted into at least two parallel columns of diapers which continue to travel in the same direction on the same drum as the drum rotates. This type of operation is not suitable for guiding flexible work pieces alternately into different travel directions toward different stackers.

It is also known to use flippable, or rotatable deflectors for diverting a work piece from a given travel direction into another travel direction, as disclosed in U.S. Pat. No. 3,980,183 (Anikanov et al), U.S. Pat. No. 3,851,773 (Kluge et al), and U.S. Pat. No. 3,279,188

(Stephenson). Such mechanical deflectors must be precisely synchronized with the feed advance and even slight deviations from the proper deflector operation or minor variations in the locations of work pieces travelling toward the deflector can cause substantial jamming.

OBJECTS OF THE INVENTION

In view of the foregoing it is the aim of the invention to achieve the following objects singly or in combination:

to provide a method and apparatus which make it possible to produce packages or stacks of flexible work pieces containing the proper number of items in the proper position or positions in spite of a high operational speed of the main machine which produces the work pieces;

to permit a free selection of the number of work pieces for each stack or package;

to reduce the collating speed by dividing an oncoming flow of work pieces for travelling along at least two separate paths;

to control the collating in accordance with the number of work pieces that are to be contained in each stack; and to distribute or guide work pieces alternately into different travel directions toward different stackers without the use of a flipping member.

SUMMARY OF THE INVENTION

According to the method of the invention the work pieces must run at least through one branching station and downstream of the branching station into compartments of at least two depositors each comprising several compartments, whereby the depositors then deposit the work pieces on a stacking surface of a stationary table.

More specifically, work pieces are stacked in predetermined positions according to the invention by moving a first perforated conveyor around a first perforated suction drum, advancing said work pieces on said first perforated conveyor in a given feed advance direction to said first perforated suction drum forming part of a branching station, providing second and third perforated conveyors and respective second and third perforated suction drums in said branching station for alternating cooperation with said first perforated conveyor and first suction drum for guiding work pieces alternately into different travel directions toward at least two different depositing devices, and transferring said work pieces from said depositing devices onto a stacking table for forming stacks on said stacking table.

With the aid of the features according to the invention it is now possible to perform the distribution and collating operation at a substantially reduced speed as compared to the operational speed of the main machine. Thus, sufficient time is gained for the separation, the pressing down, and for the continued transport or rather for the supplying to a packaging machine. Furthermore, packages containing any desired number of work pieces may be formed because the speed of the transport mechanism for the continued transportation and its controller are easy to control in view of the reduced speed of the distribution operation.

The apparatus according to the invention comprises at least one branching station in the feed advance path and downstream thereof at least two depositors each with several compartments and each including a stacking table or the like to provide a stationary surface for receiving work pieces.

The branching station is formed by suction drums which take over the flexible work piece and lead it on into one of two possible directions. This feature reduces the operational speed to one half. By employing further distribution or branching stations, the operational speed can be reduced again without reducing the output of the stacking system.

According to the invention work pieces, especially flat, flexible work pieces, are switched out of a first travel direction into one of at least two further travel directions by the combination and cooperation of at least three perforated suction drums, two of which are arranged alongside a first suction drum forming an in-feed drum, while the at least two further suction drums are take-over and discharge drums. This feature of the invention has the advantage that it is not necessary to mechanically flip a deflector, having a certain mass, back and forth. The suction drums work well even at high rotational speeds since flipping the mass of a mechanical deflector back and forth has been eliminated. Further, a small overlap in the suction controls of the three suction drums is desirable because it assures a proper transfer of a work piece from the first roller to the second roller or from the first roller to the third roller. An overlap in the suction control means that the suction of the first drum may still be effective for a few degrees of drum rotation while the suction of the second or third drum is already effective.

BRIEF DESCRIPTION OF THE DRAWINGS

In order that the invention may be clearly understood, it will now be described, by way of example, with reference to the accompanying drawings, wherein.

Figure 1:
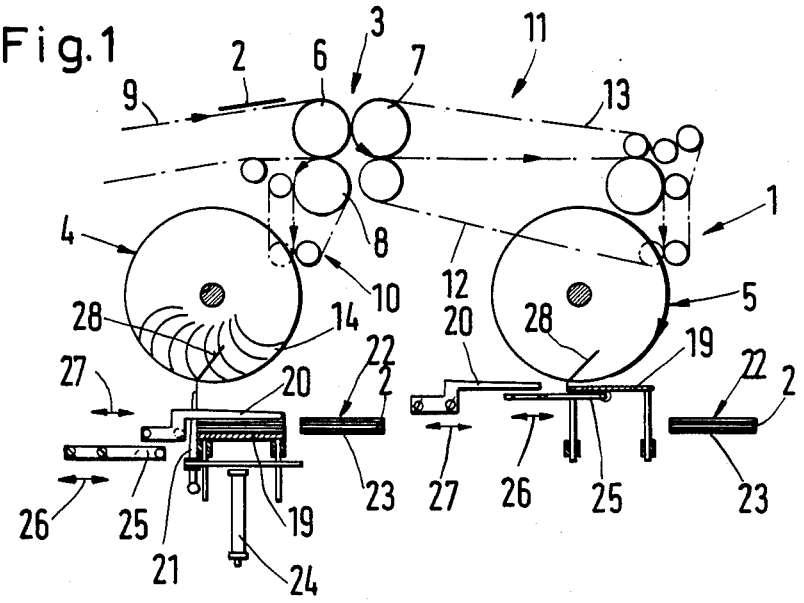
FIG. 1 shows a schematic side elevational view of one embodiment of the apparatus according to the invention.

DETAILED DESCRIPTION OF PREFERRED EXAMPLE EMBODIMENTS AND OF THE BEST MODE OF THE INVENTION:

An apparatus 1 for the deposition or distribution of a proper number of flexible work pieces 2 in a proper position comprises at least one branching station or switch 3 which further comprises at least two distribution devices or depositors 4, 5.

The switch 3 forming the branching station comprises an arrangement of suction drums 6, 7 or 8 by means of which work pieces transported to the branching station on a first conveying means, such as a perforated conveyor belt 9 in a first feed advance direction, are selectively switched to a depositor 4 or to a depositor 5 through one or the other conveying mechanism 10, 11.

The conveying mechanism 10 comprises two conveyor belts **10*a* and 10*b*. Belt 10*a* is also a perforated belt and runs around the suction drum 8. Belt 10*b* does not need to be perforated and runs around respective guide rollers. The conveying mechanism 11 comprises several conveyor belts or groups of conveyor belts which run around guide rollers. The conveying mechanism 10 takes over the work piece with the aid of its suction drum 8 directly from the suction drum 6 which simultaneously forms a guide roller of the conveyor belt 9. The other conveying mechanism 11 receives work pieces from a suction drum 7 which takes over the work piece from the suction drum 6 in accordance with a respective pressure or rather suction control to be described in more detail below with reference to FIGS. 11, 12 and 13. The suction drum 7 is further a guide roller for the conveying mechanism 11, that is, concretely, the guide roller of the belt 13 which holds a work piece on the supporting conveyor belt 12. The belt 13 is perforated for applying the suction to a work piece 2**.

The guide rollers and conveyor belts of both conveying mechanisms 10 and 11 are arranged in such a manner that the work piece 2 after passing through a transport path extending from above downwardly, reaches the disk shaped depositors 4, 5 approximately tangentially, whereupon the work piece is taken over by the compartments 14 having an approximate spiral cross-sectional shape, said compartments forming part of the depositors 4 and 5.

Figure 2:
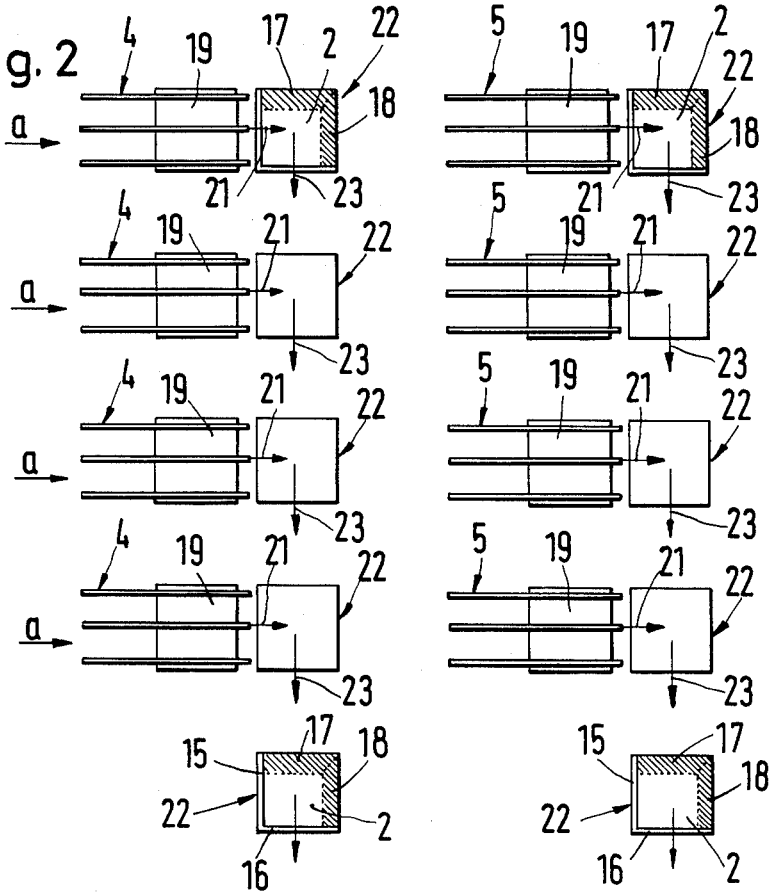
FIG. 2 is a top plan view of a scheme of operational steps of several apparatuses according to FIG. 1.

The conveying mechanism 11 and its depositor 5 are located directly behind or rather downstream of the depositor 4 as viewed in the transport direction or main feed advance direcion of the conveyor belt 9 from left to right in FIG. 1. The running direction of the depositors 4 and 5 is the same in the example embodiment illustrated in FIG. 1. As a result, the work pieces 2 are deposited in a uniform or aligned manner. Thus, the folding edges 15, 16 as well as the embossed margins 17, 18 of the work pieces 2 are in an aligned or parallel position with each other after the depositing, as is shown in FIG. 2.

A lowerable stacking table 19, a pressing device 20, and a pushing mechanism 21 are provided for each of the two depositors 4, 5. The pressing device compresses a stack on the stacking table 19. The pushing mechanism 21 pushes stacks 22 formed on the lowerable stacking table 19 onto a transport mechanism 23 for a continued conveying. The continued conveying is performed by the transport mechanism 23 shown in FIG. 2 merely by arrows, because belt conveyors suitable for this purpose are known in the art.

The lifting and lowering of the stacking table 19 takes place either with the aid of a piston cylinder device 24 or with the aid of an arm 25 which is supported by means of guide members not shown in detail in the same manner as the pressing device 20. In its operational position, see FIG. 1 right hand side, the arm 25 reaches below the stacking table 19 and lowers the stacking table 19 slowly when the guide members are being tilted. The arm 25 and the pressing device 20 reciprocate back and forth in the manner of a parallel-type crank movement as shown by dash-dotted circles 26, 27 during a complete work cycle, whereby the arm 25 and the pressing device 20 may be driven by conventional piston cylinders in the form of parallel-type cranks not shown.

The pressing device 20 does not reach under the stacking table 19 as does the arm 25, but rather reaches onto the top of a stack 22 as soon as the stack is completed.

The stacking of the work pieces 2 on the stacking table 19 takes place with the aid of a stripper 28, which grips into the compartments 14 of the depositor 4 or 5. Such strippers as such are conventional. The transfer of the stack 22 from the stacking table 19 to the continued conveying transport mechanism 23 takes place with the aid of the pushing mechanism 21, as mentioned.

The two depositors 4 and 5 and their auxiliary devices are identical to each other. Any differences in FIG. 1 merely show different working positions for providing a better overall view.

The pressing device 20 as well as the pushing mechanism 21 are fork-shaped, so that their back and forth movements do not interfere with each other.

FIG. 2 shows schematically two groups of four each depositors 4 and depositors 5. FIG. 2 further shows the work scheme with work pieces 2 arriving on a conveyor belt 9 in the main feed advance direction of the arrow "a" and work piece stacks 22 are transported away on two transport mechanisms 23 perpendicularly to the feed advance direction of the conveyer belt 9 in a second transport direction.

It is to be understood, that the feed advance speed of the transport mechanism 23 is adapted to the operational speed of the depositors 4, 5 for assuring the required synchronism.

Figure 3:
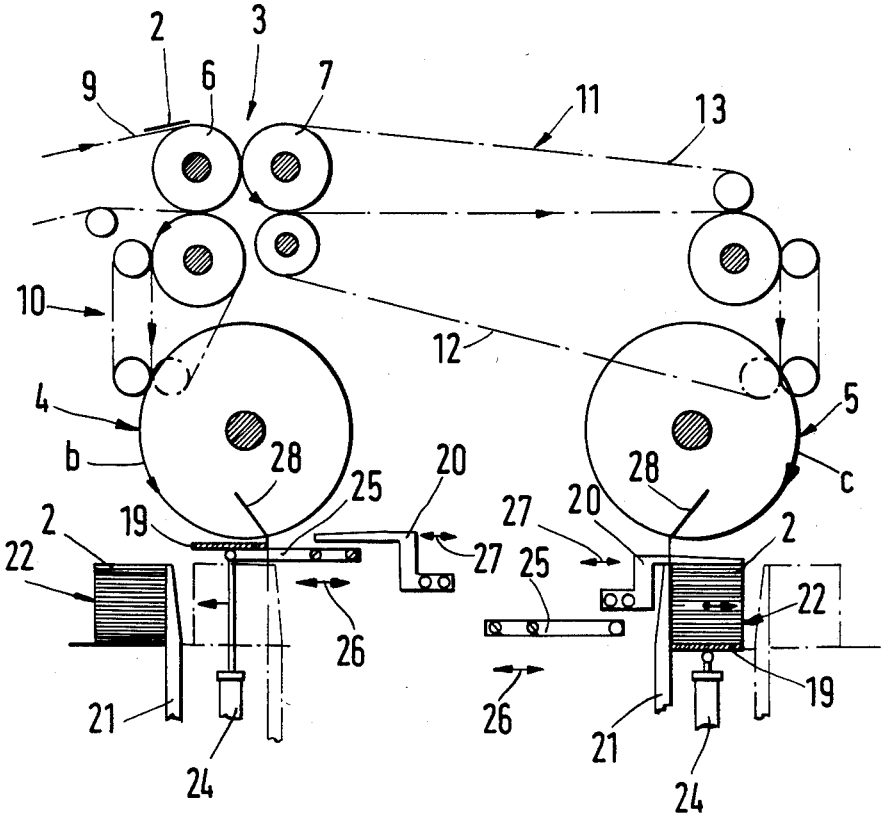
FIG. 3 is a side elevational view as in FIG. 1, of a modified embodiment.

The two depositors 4 and 5 in the example embodiment according to FIG. 1 rotate in the same sense, this is not the case in the example embodiment according to FIG. 3. Here, the depositors 4 and 5 rotate in opposite directions according to the arrows "b" and "c", whereby the work pieces 2 on the stacking tables 19 are deposited in different positions. For example, this has the result, that work pieces arriving on the conveyer belt 9 in the same position face each other with their folding edges 15 after the stacking. This position results clearly from the work scheme of FIG. 4, which again shows depositors 4 and 5 in groups of four and the leading together of the stacks 22 formed by these depositors 4, 5 onto a transport belt 29 running in a direction across the direction of movement of the two transport mechanisms 23. The transport mechanisms 23 as well as the transport belt 29 are shown in FIG. 4 merely with the aid of arrows in a schematic manner.

Figure 4:
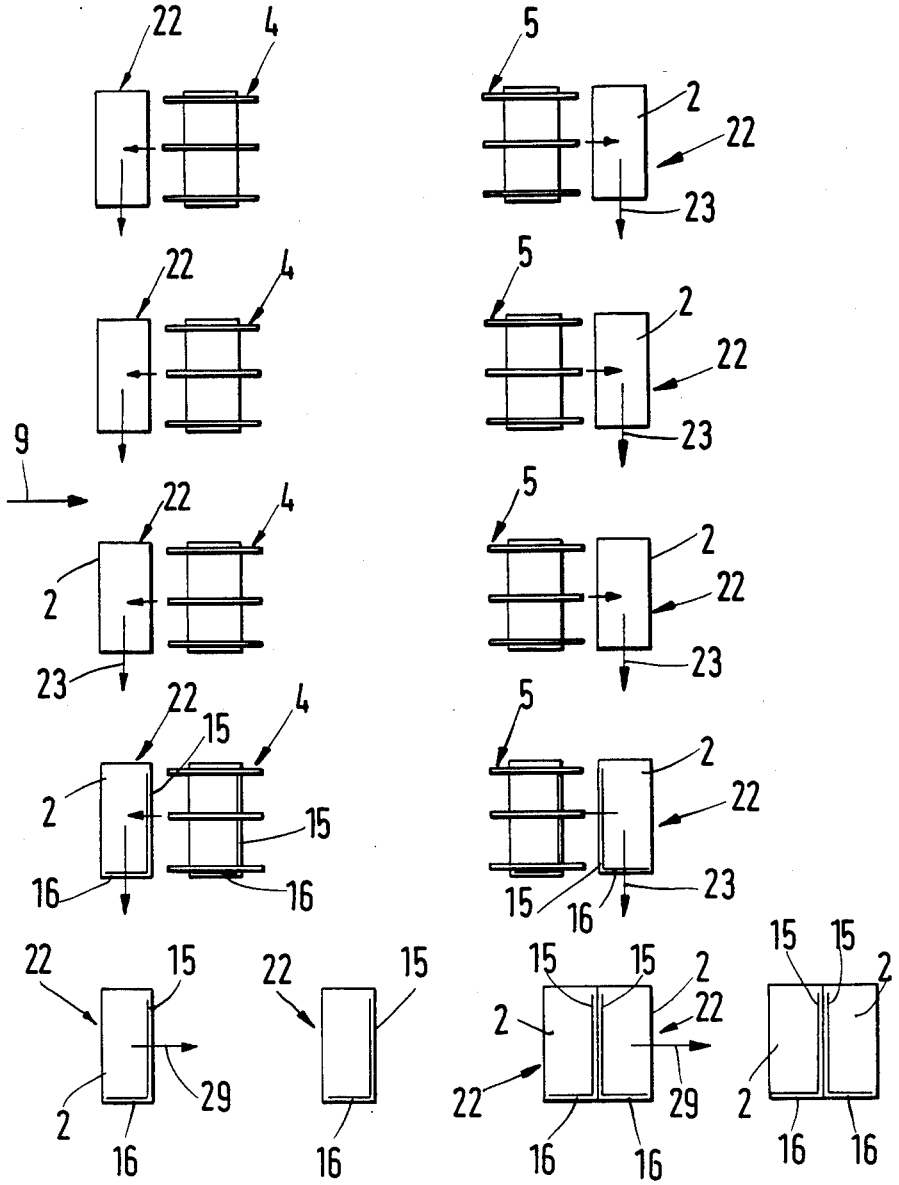
FIG. 4 is a top plan view onto the operational steps of the apparatus according to FIG. 3.

In the example embodiment illustrated in FIGS. 3 and 4 the conveying belt 29 transports in a direction parallel to the feed advance direction of the conveying belt 9. The transport mechanisms 23 convey in a direction extending cross-wise relative to the original feed advance direction "a" and relative to the movement direction of the belt 29.

Figure 5:
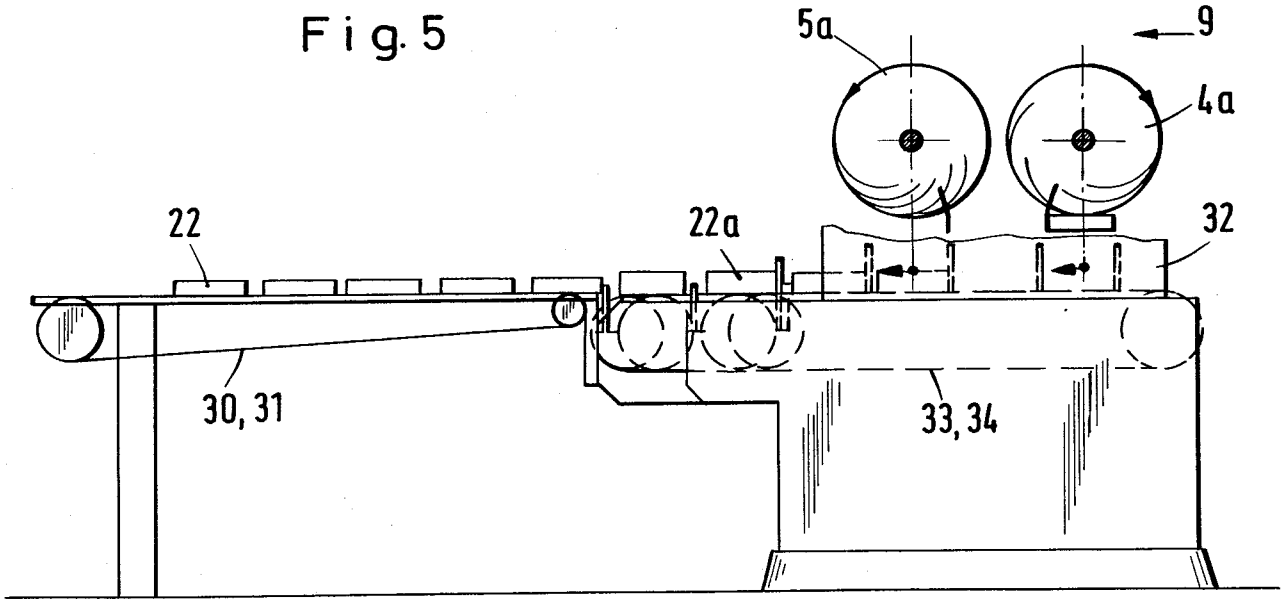
FIG. 5 is a side elevational view of a further embodiment.
Figure 6:
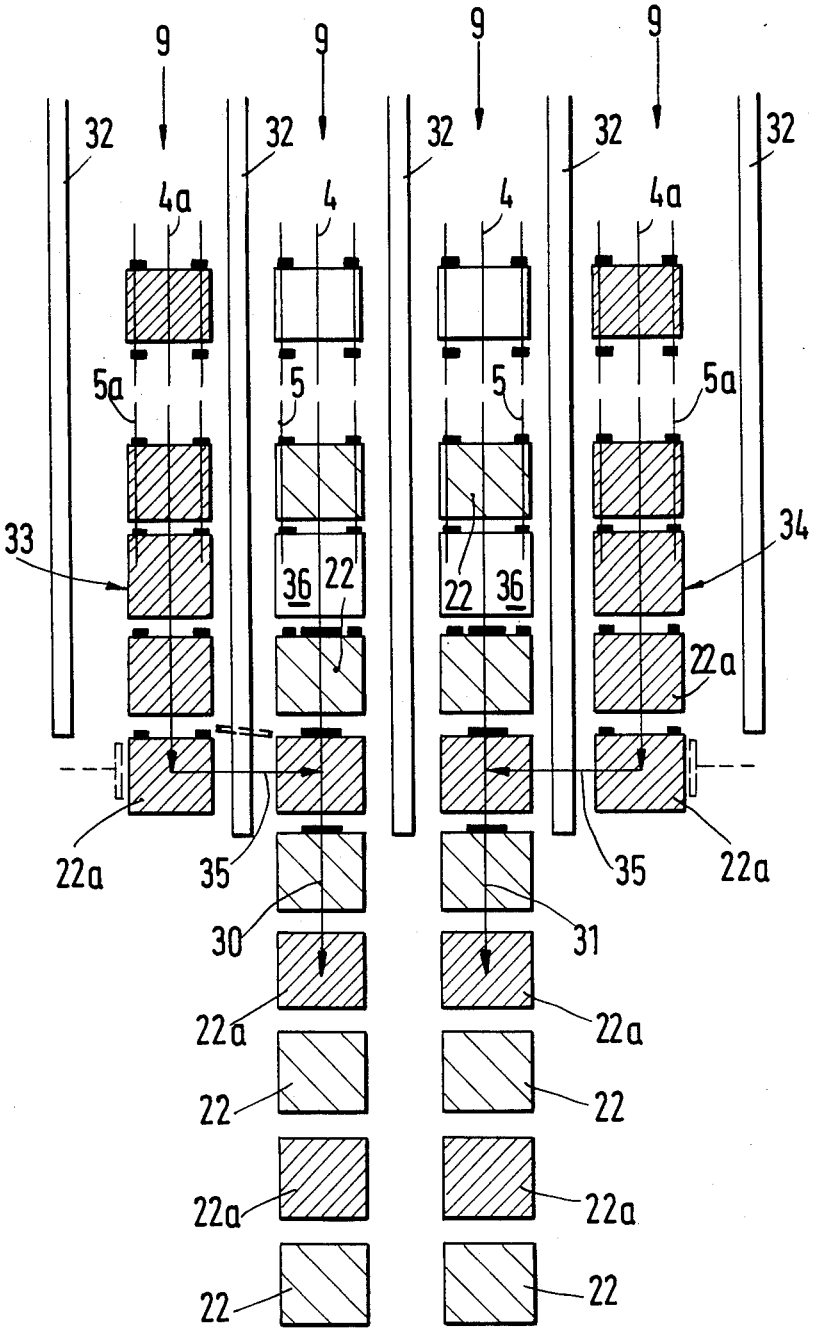
FIG. 6 is a top plan view of the apparatus according to FIG. 5.

FIGS. 5 and 6 show schematically an embodiment having a continued conveying transport mechanism 30 or 31 which transports in the same direction as the original feed advance direction of the conveying belts 9 which transport the work piece or work pieces 2 to the depositor or to the depositors 4, 5 through the branching station 3. These conveying belts 9 or rather their transport direction is indicated in FIGS. 5 and 6 again only with the aid of arrows representing the conveyer belts 9.

The embodiment according to FIGS. 5 and 6 comprises supporting walls 32 with the depositors 4 and 5 arranged between the walls 32 in two rows of four each. Bearings 1, not shown, for rotatably mounting the depositors **4, 5, 4*a*, 5*a* are secured to the walls 32. The continued conveying transport mechanisms 30 and 31 are arranged for direct cooperation with the centrally located pairs of depositors 4 and 5. Conventional transport mechanisms 33, 34, such as belts, are provided for the outwardly located pairs of depositors 4*a* and 5*a*. The transport mechanisms 33, 34 transport the work pieces 2 only for a short distance, whereupon the work pieces 2 are transferred to the respective neighboring, continued conveying transport mechanisms 30 and 31 with the aid of a transfer mechanism which is not shown in detail and merely indicated by arrows 35. A piston operated rod of conventional construction could be used for pushing the work pieces 2 from the conveyor 33, 34 onto the conveyor 30, 31 respectively. The occupation of the transport positions on the continued conveying transport mechanisms 30 and 31 is thereby so selected, that, as viewed in the transport direction, one transporting position 36 remains free behind the two depositor pairs 4, 5. Thus, the stacks 22*a* coming from the outwardly located depositor pairs 4*a*, 5*a* and introduced by the transfer mechanisms 35 can find a free position in the conveyer belt of the transport mechanism 30 or 31**.

The transfer mechanisms 35 are reduction stations with the aid of which work pieces arriving on several transport mechanisms, such as conventional conveyer belts, may be collated for a continued conveying on a single transport mechanism such as a belt. Details of the reduction station are not shown in FIGS. 5 and 6 and are not the subject of the invention, since a piston rod moving a pusher blade back and forth is conventional. The two conveyor belts 30 and 33 are sufficiently closely spaced from each other and any gap therebetween may be bridged by a smooth stationary surface so that pushing the work pieces across from one conveyer belt onto the next adjacent conveyer belt does not pose any problem. The same applies to the conveyer belts 31 and 34. All conveyer belts 30, 31, 33, 34 are conventional endless belts running around respective guide rollers at least one of which is positively driven, for example by a conventional chain drive. The centrally located belts 30, 31 are driven twice as fast as the outwardly located belts 33, 34 so that the above mentioned free positions are formed.

Figure 7:
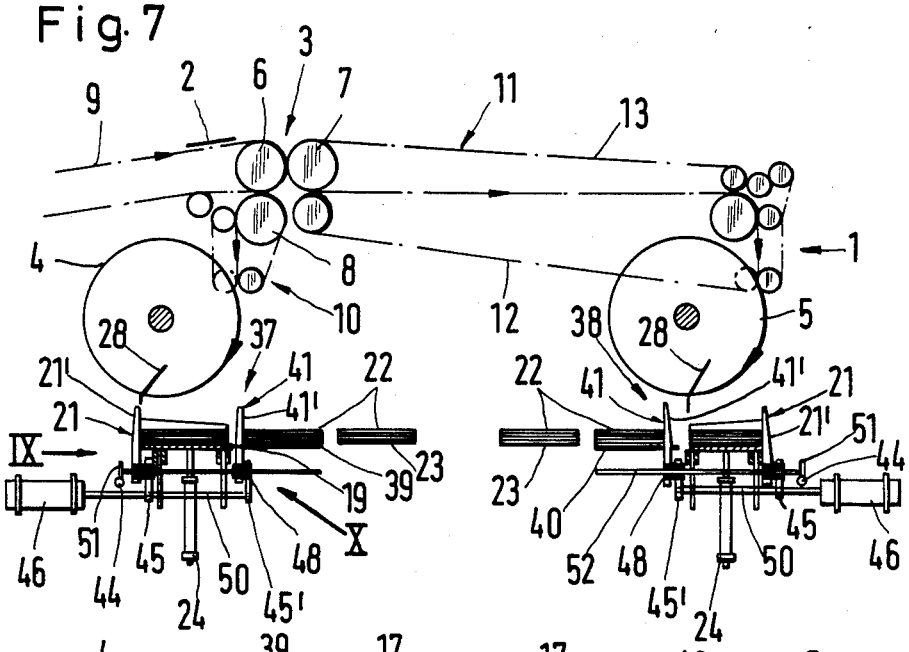
FIG. 7 is a side elevational view of an embodiment including a stacking table having one waiting position.
Figure 8:
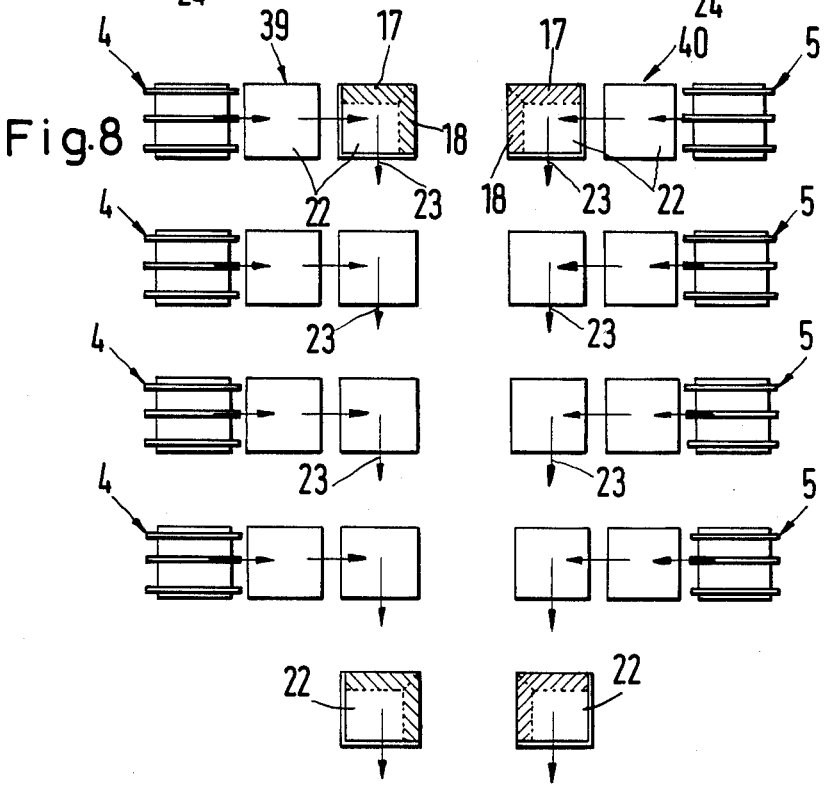
FIG. 8 is a top plan view onto the apparatus according to FIG. 7.

FIGS. 7 and 8 illustrate a further embodiment in a schematic side elevational view including an enlarged stacking table 37 or 38, whereby the top plan view of FIG. 8 shows the operational scheme of this embodiment. Due to the size of the stacking tables 37, 38 the latter comprise a waiting position 39 or 40 on which the work pieces 2 may be intermediately stacked before they are passed on in the form of a stack 22 to a continued conveying transport mechanism 23 in accordance with the arrows shown in FIG. 8. The transfer takes place with the aid of a pushing mechanism 41 which operates basically similarly as the pushing mechanism 21 at the stacking location below the depositor 4 or 5.

The position of the work pieces 2 in the stacks 22 is again of uniform orientation or mirror-inverted depending on the direction of rotation of the depositors 4 and 5.

Figure 9:
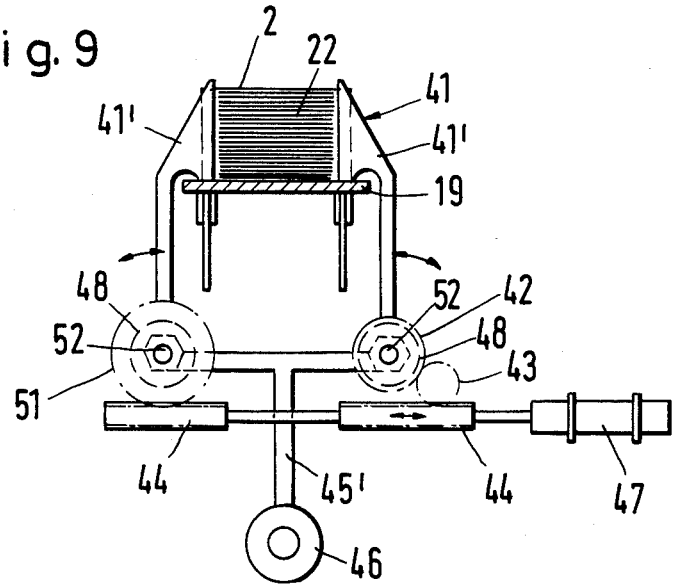
FIG. 9 is a detail of the apparatus according to FIG. 7 on an enlarged scale in the direction of the arrow IX.
Figure 10:
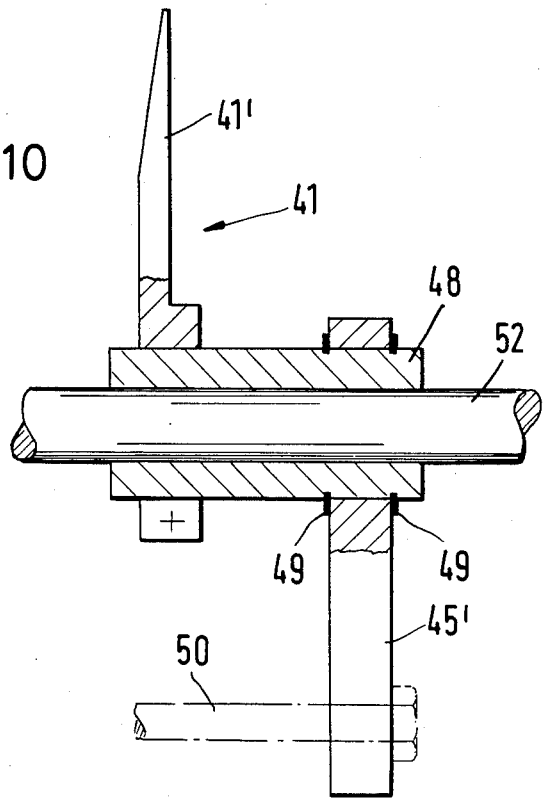
FIG. 10 is a view in the direction of the arrow X in FIG. 7 with a ball guide and a ball guide bushing as a detail.

As shown particularly in FIGS. 7, 9, and 10, two pushers 41' are preferably provided for each pushing mechanism 21 or 41, said pushers being arranged on ball guide bushings 48 and secured against rotation. The bushings 48 are mounted on rod-type ball guides 52 whereby the bushings are displaceable in their longitudinal direction. Preferably, the ball guide bushings 48 are only axially displaceable on the ball guide 52 and not tiltable, that is, they are secured against rotation. The rodtype ball guides 52, however, are rotatably or tiltably supported, preferably at their ends, in a manner not illustrated in detail, so that the ball guide bushings 48 or the pushers 21' or 41' provided for each pushing mechanism 21 or 41 are tiltable about the rod-type ball guides 52.

Further, a common drive member 45 or 45' is provided for operating the pushers 21, 21'. The drive member 45' for the pushing mechanism 41 is rigidly connected to the drive member 45 for the other pushing mechanism 21 by means of a connection 50 forming a rod-type coupling. A pushing-out cylinder 46 or rather its extended piston rod operating as a coupling, engages the two drive members 45 and 45' for moving the pushers 21' and 41' simultaneously (see FIG. 7).

Gear wheels 42 and 51 are arranged at the respective ends of the two ball guides 52. A further gear wheel 43 meshed with the gear wheel 42. A toothed rack 44 is arranged below the two gear wheels 43 and 51 for meshing therewith. The rack 44 is movable back and forth with the aid of a pushing cylinder 47.

The toothed rack 44 engages directly the gear wheels 43 operating as an intermediate wheel thereby moving the gear wheel 42 indirectly. As soon as the pushing cylinder 47 moves the toothed rack 44, the pushers 21' or 41' of the two pushing mechanisms 21 and 41 perform respectively oppositely directed rotational movements about the rod-type ball guides 52 serving as rotational axes. The different rotational direction results due to the intermediate wheel 43. Thus, the pushers 21' and 41' are alternately tiltable out of the direction of movement of the stacks 22 and into this direction of movement.

The different individial features of the pushing-out mechanism according to FIGS. 9 and 10 could be employed in the same manner in the example embodiments according to FIGS. 1 and 3. Thus, after the pushing-out operation, the pushers 21' can be moved back into their starting position, whereby they pass by the new stack 22 as it is being formed on the stacking table 19.

In order to make sure that the suction drums or rollers 6, 7, and 8 and the corresponding conveyer belts 9, 12 and 13 operate as a branching station or rather as a switch 3, it is necessary that the belts have perforations or otherwise permit air to pass through the belts and that the application of reduced pressure to the suction rollers 6, 7, and 8 is exactly controlled in a proper time sequence. A serve-control device 60 shown in Figs. 11 and 12 serves for this purpose. The servo-control device 60 comprises two servo-valves 61 and 62 which are mirror-symmetrical to each other. Therefore, only the servo-valve 61 will be described. The servo-valve 62 operates in the same manner. The suction drums or rollers 6, 7 and 8 are similarly constructed relative to each other, so that again only the suction roller 6 will be described in detail.

The servo-control valve 61 comprises a control disk 63 mounted to freely rotate on an axis 64. Control heads 65 and 66 which are rigidly secured to the axis 64 are located on both facing sides of the control disk 63. Thus, the disk 63 rotates relative to the control heads 65 and 66. The control disk 63 further comprises a control window 67 and each of the control heads 65 and 66 comprise a control channel 68, 69 which faces the control disk 63 and which cooperates with the control window 67. The control channels 68, 69 are located opposite each other and are congruent to each other. Further, the channels 68, 69 extend along a circular arc over a portion of the facing surfaces of the control heads 65, 66 which have a circular disk shape as is particularly evident from FIG. 11.

A reduced pressure generator 70, such as a vacuum pump 70 driven by a motor M, is provided for producing a reduced pressure at the suction drums or rollers 6, 7, and 8. This reduced pressure generator 70 is connected through a conduit 71 to the servo-valve 61 and through a conduit 72 to the servo-valve 62. The conduit 71 and correspondingly the conduit 72 is connected to one control head 65 of the respective servo-valves 61, 62 and is further connected through a bore 73 to the control channel 69. When the control disk 63 rotates about the fixed axis 64 the control window 67 passes along the control channels 68 and 69 so that they are interconnected in an air-passing manner. Thus, the reduced pressure present in the control channel 69 of the control head 65 is then also present in the control channel 68 of the other control head 66. A conduit 74 leads from the control head 66 through branching conduits 75 and 76 to one control head 77 on the suction roller 6 and to an equivalent control head 77 on the other suction roller 8. A bore 78 connects the conduits 74 to the control channel 68 so that respectively reduced pressure is applied to the control heads 77 of the two suction rollers 6 and 8 when the control window 67 establishes the air conducting connection between the suction pump 70 and the control heads 77 at the suction rollers 6 and 8. As mentioned, the control disk 63 rotates relative to the two control heads 65, 66.

Figure 12:
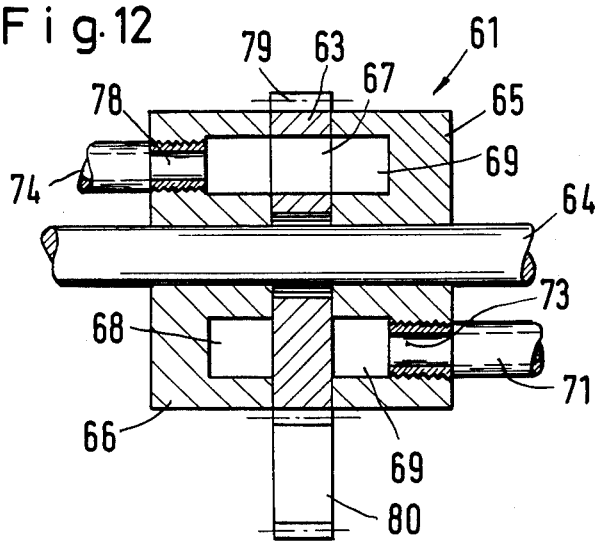
FIG. 12 shows a sectional view along section line XII—XII in FIG. 11.
Figure 13:
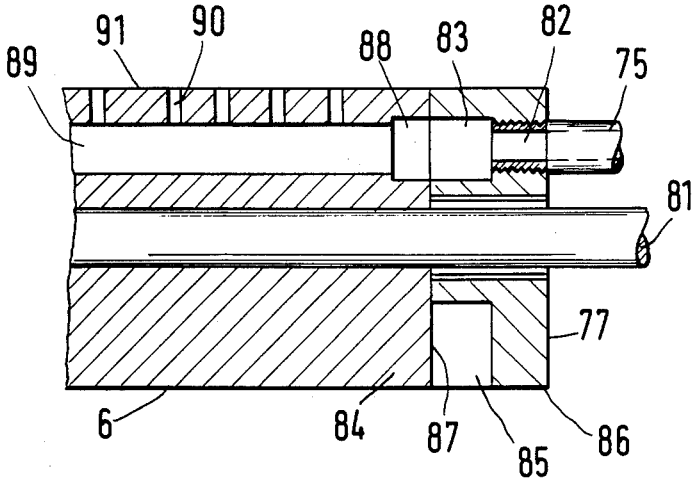
FIG. 13 is a partial sectional view through a suction drum of FIG. 11.

In order to rotate the control disk 63, it may be provided around its circumference with gear teeth 79 meshing with a driven pinion 80 (FIG. 12). Thus, depending on the position of the control disk 63 reduced pressure is established in the suction rollers 6 and 8 or atmospheric pressure prevails in the suction rollers 6 and 8 which are perforated. In order to achieve this reduced pressure distribution, the control head 77 of the suction rollers 6 and 8 or also 7 is rigidly mounted on an axle 81 to remain stationary. The control head 77 is provided with a bore 82 to which the branching conduits 75 or 76 are connected. The bore 82 leads to a control channel 83 which extends as an arc along a portion of a circular arc on the facing surface 84 of the control head 77. Further, a channel 85 for a pressure equalization is provided in the facing surface 84. This channel 85 is connected to the atmosphere and for this purpose it reaches preferably all the way to the circumference 86 of the control head 77.

The suction roller 6 or 8 has in its surface 87 facing the control head 77 a control window 88. A longitudinal bore 89 having several suction holes 90 is connected to the control window 88. The suction holes 90 lead from the longitudinal bore 89 to the circumference 91 of the suction rollers 6, 7, or 8. As long as reduced pressure is effective at the suction holes 90 through the conduit 75, 76 a work piece remains stuck on the suction roller, so that the latter can transport the work piece. As soon as the reduced pressure is removed, the work piece can also be removed either by gravity or by the next suction roller located downstream of the first mentioned suction roller and provided with reduced pressure. Generally, as soon as the reduced pressure is removed from a suction drum, the work piece can be taken over by the next feed advance mechanism. The removal of the reduced pressure takes place always when the control window 88 of the suction roller 6 passes along the channel 85 of the control head 77. During this instant atmospheric pressure is present also in the longitudinal bore 89 and at the suction holes 90, whereby the work piece being transported can be removed from the respective roller as mentioned.

Figure 11:
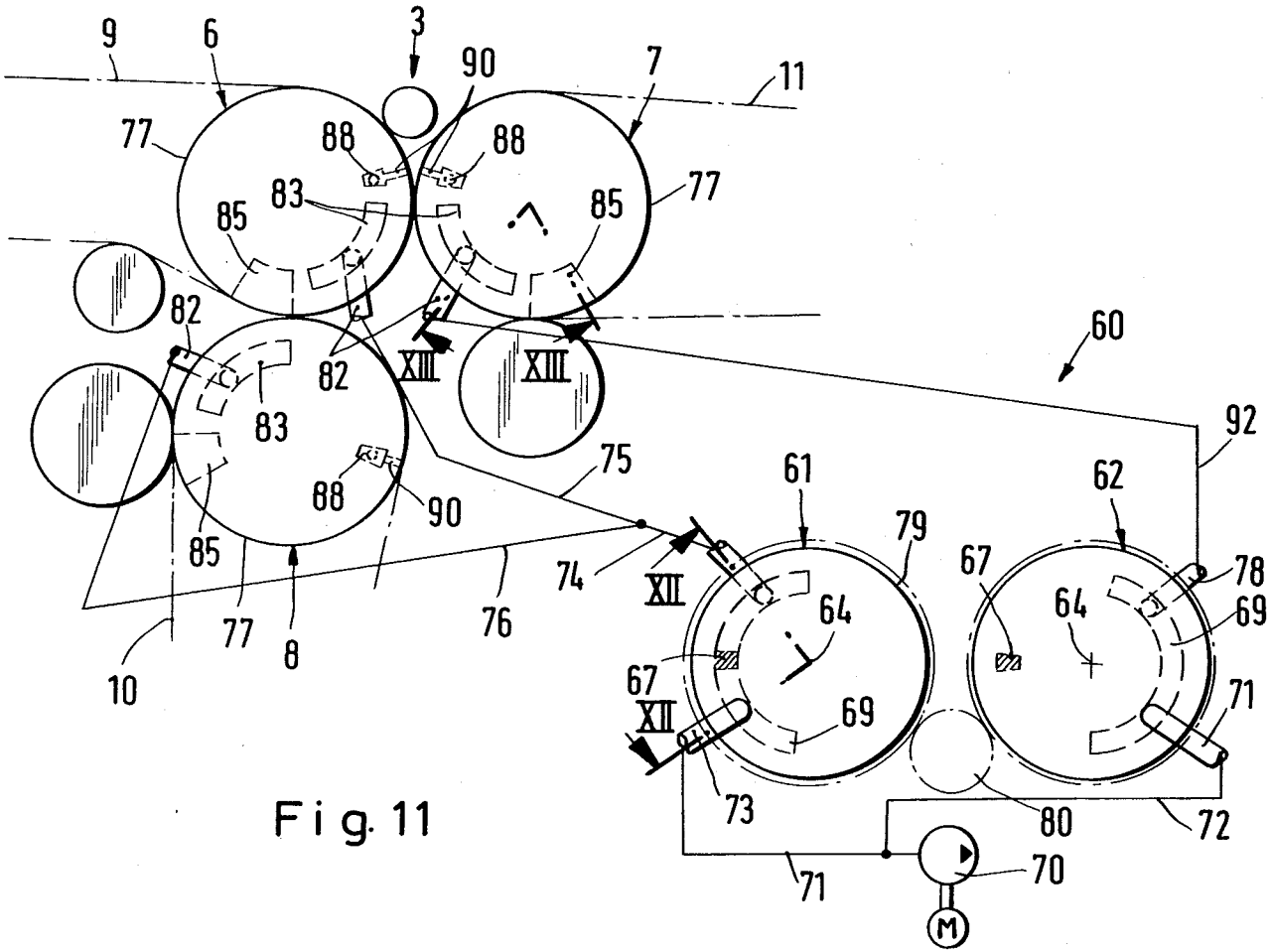
FIG. 11 shows on an enlarged scale details of the suction control of the suction drums of FIG. 1.

The position of the control channel 83 relative to the channel 85 is clearly disclosed in FIG. 11 showing that the suction force becomes effective, when the control window 88 at the suction roller passes over the control channel 80. Further, the suction force ends again, when the control window 88 starts cooperating with the channel 85.

The second servo-valve 82 in FIG. 11 is connected with the control head 77 of the suction rollers 7 through a conduit 92. All components are arranged mirror symmetrically relative to the components of the control valve 61 and otherwise correspond to the already described components and function respectively.

The described control of the reduced pressure or suction makes sure, that either the suction rollers 6 and 8 are connected to the vacuum pump 70 or that the suction roller 7 is connected to the vacuum pump 70. Accordingly, work pieces arriving on the conveyor belt 9, such as napkins, are either guided by the suction cylinders 6 and 8 to the depositor 4 or by the suction cylinder 7 to the depositor 5.

The servo-control valves 61 and 62 provide for each revolution of the control disk 63 suction air throughout an angle of 180°. When one of the servo-control valves produces reduced pressure, the other one is closed and vice versa. The servo-control valves 61 and 62 are driven by a gear drive in such a manner, that the respective control disks 63 rotate through 180° during a time period corresponding to the time needed for delivering a predetermined number of work pieces on the conveyor belt 9. Upon completion of a rotation of 180° the control disk 63 interrupts the reduced pressure in one servo-control valve and thus in the respective connected conduit, so that the branching station or switch switches over and the work pieces are then being guided to the other continued conveying feed advance mechanism. The described servo-control mechanism represents but one possible example for the generation and control of the reduced pressure in the suction drums or rollers.

Each distribution device 4, 5 comprises three disks forming compartments and rotating with a respective shaft. The stationary strippers 28 reach into the spaces or pockets between the disks. The operation is such that the work pieces 2 resting in the compartments or pockets 14 contact the stripper 28 with the leading edge of the work piece, whereby the work piece is taken out of the compartment 14 and placed on the stacking table 19 for forming a stack.

The above mentioned parallel-type cranks as represented by the dash-dotted circles 26, 27 for driving the arm 25 and the pressing device 20, do not perform a completely circular movement, rather, they perform an oscillating back and forth movement, whereby the respective cranks 26, 27 rotate through part of a circle in one direction and then again in the opposite direction. During the lowering movement of the stacking table 19 when a stack is being formed, the parallel-type crank drives 26, 27 are driven slowly by the drive members 111, 114 shown in FIG. 14. Thereafter, this drive motion is accelerated for the pressing operation taking place immediately after the stack formation is completed and such acceleration is accomplished by the drive members 112, 115 of FIG. 14. The return tilting movement of the arm 25 and of the pressing device 20 also takes place at a rapid speed by means of the drives 113, 116 of FIG. 14, whereby the stacking table 19 is returned into its starting position by the piston cylinder device 24. The pressing device 20 is adjustable in its vertical spacing from the arm 25 and thus also from the stacking table 19 for adjusting the desired stacking height.

Incidentally, the control of the suction air for the branching station 3 depends on the number of work pieces 2 to be included in each stack. An intermediate gear wheel 80 shown in FIG. 11 and in FIG. 12 participates in the driving of the suction air control 60 shown in FIG. 11 and determines the number of work pieces to be included in each stack. Changing the gear wheel 80 enables the changing of the number of work pieces in a stack.

Figure 14:
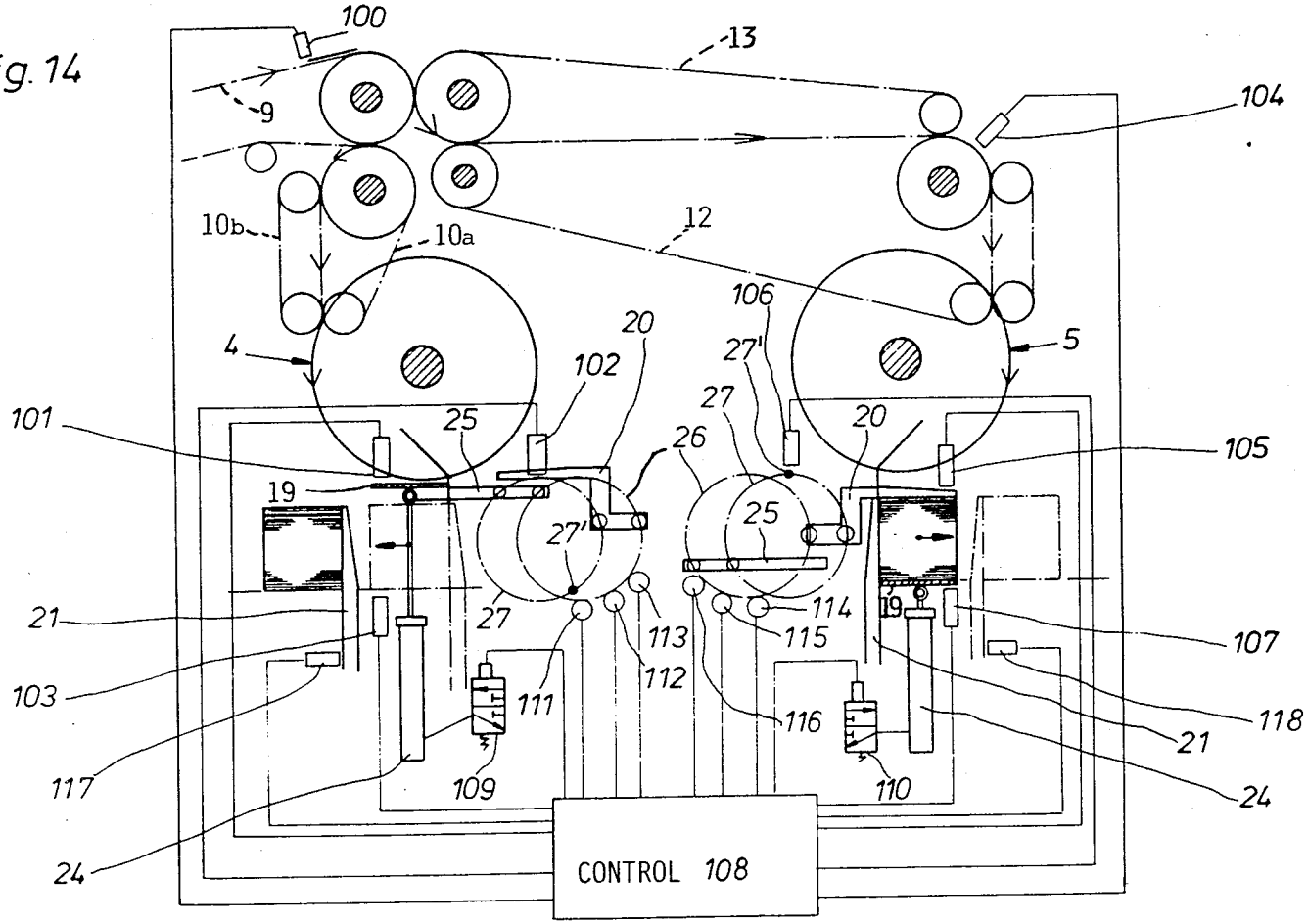
FIG. 14 is a view similar to FIG. 1, but showing additionally sensors and a control device for coordinating the various machine operations.
Figure 15:
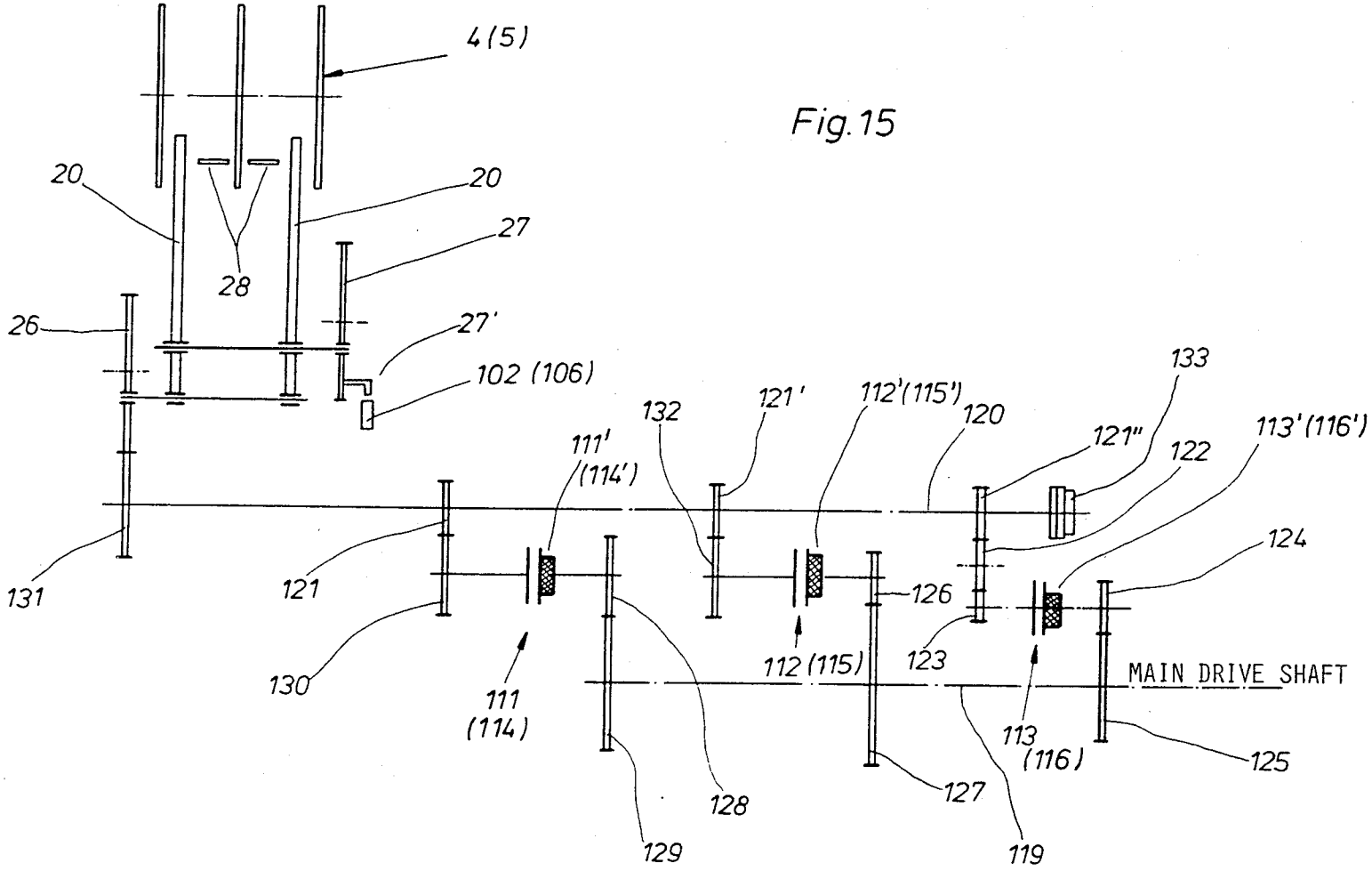
FIG. 15 is a schematic drive diagram for operating the parallel-crank type drives.

Referring now to FIGS. 14 and 15, the drive for the parallel-type crank drive 26, 27 and thus for the arms 25 and the pressing device 20 is shown in FIG. 15 while FIG. 14 shows a block diagram incorporated in an illustration similar to that of FIG. 3 for showing the control of the sequence of the machine operations. The drive motion is derived from a main drive shaft 119 and transmitted to the parallel-type crank drives 26, 27 through the electromagnetically operated clutches 111, 114 or 112, 115, or 113, 116 for driving the drive shaft 120 and the drive element 131 operatively connected to the parallel type cranks 26, 27. For lowering the stacking table 19 the respective power is transmitted from the main drive shaft 119 through the the gear wheels 129 and 128, through the clutch 111, 114, and through gear wheels 130, 121, the latter driving the shaft 120. For pressing a finished stack, the drive of the shaft 119 is transmitted through the gear wheels 127, 126, through the clutch 112, 115 and through the gear wheels 132, 121', the latter again tilting or oscillating the shaft 120. The return oscillating movement of the parallel type crank drives 26, 27 is accomplished by transmitting the drive from the shaft 119 through the gear wheels 125, 124 and the clutch 113, 116, the gear wheel 123, the direction reversing gear wheel 122, and the gear wheel 121'' driving the shaft 120 now in the opposite direction. There are two crank drives 126, one for each stacking station, and two crank drives 27 again one for each stacking station. Each crank drive requires three clutches so that there are a total of twelve clutches only six of which are symbolically shown in FIG. 14. However, in FIG. 15 each clutch is provided with four reference numbers to symbolize the total number of twelve clutches. Thus, the clutch 111, 114 is also designated with the reference number 111' and 114'. Similarly, the clutch 112, 115 is also designated with the reference number 112' and 115'. The clutch 113, 116 is also designated with the reference number 113', 116'.

Referring to FIG. 14, a sensor 100 counts the work pieces 2 delivered by the perforated conveyor 9 and supplied the respective signal as an input signal to the control device 108 of conventional construction to cause the start of a stacking cycle. The control device 108 also receives an input signal from the sensor 104 sensing the presence of work pieces on the conveyors 12, 13 for deciding whether the stacking station 4 or the stacking station 5 is to start a stacking cycle. Each stacking cycle is the same as the other and they take place in sequential order. Thus, only an operational cycle of the stacking station 4 will now be described.

A cycle starts by energizing the clutch 111', shown in FIG. 15, and the stacking table 19 is slowly lowered while work pieces 2 are being sequentially deposited on the lowering stacking table 19. When the stacking table 19 reaches its lower most point corresponding to a desired stack height, the sensor 103 provides a respective signal to the control device 108 which in turn starts the pressing device 20 for compressing a stack on the stacking table 19. For this purpose the clutch 111' is deenergized and the clutch 112' is energized. When a trip dog 27' secured to the respective parallel crank 26, 27 reaches a sensor 102 the compressing of the stack by the compressing device 20 is stopped by deenergizing by the clutch 112' and simultaneously starting the pushing out motion of the pushing mechanism 21. When the pushing mechanism 21 reaches the sensor 117, a braking action is applied and the pushing mechanism 21 is returned into its starting position. Simultaneously, pressurized fluid is supplied to the stacking table lowering piston cylinder device 24 through the valve 109 and the clutch 113' is energized, whereby the stacking table 19 is returned into its upper starting position and the respective parallel-type crank drive 26, 27 with the arm 25 and the pressing mechanism 20 are also returned into the starting position. This return movement is in response to the sensors 101 and 105.

In the meantime, the suction air has been switched in the branching station 3 for transmitting work pieces 2 to the stacking station 5. The sensors 104 and 100 now start the stacking cycle of the stacking station 5. The sensors 103 and 107 are located to be vertically adjustable to select a desired stacking height. Similarly, to determine the height of a stack after its compression, the trip dogs 27' are also adjustably located. All structural components performing a linear motion cooperate with adjustable mechanical stop members to limit the respective stroke. It has been found to be desirable for practical purposes to provide a brake 133 on the shaft 120. The brake 133 also receives its control signals from the control device 108 for stopping the movements of the parallel crank drives 26, 27.

Incidentally, the conveyor belts 9, 10, and 11 have been described as being "perforated". However, the present function of permitting the suction effect to pass through these conveyor belts is also achieved if these belts are air permeable, for example, if a plurality of narrow belts run in parallel to each other with a spacing therebetween through which the suction air can be effective.

Although the invention has been described with reference to specific example embodiments, it will be appreciated, that it is intended to cover all modifications and equivalents within the scope of the appended claims.

What we claim is:

1. An apparatus for stacking a predetermined number of flexible work pieces coming in a first number of columns from a production machine, in determined positions to form stacks of said work pieces to be supplied to a packaging machine, comprising first conveyor means (9) for transporting said columns of work pieces, a branching station (3) for each of said columns located at a downstream end of said first conveyor means for guiding sequentially arriving work pieces to move alternately into two different directions, two depositors (4, 5) for each branching station located to alternately receive work pieces from said branching station, each of said depositors comprising a plurality of compartments for temporarily holding work pieces received from said branching station, two stacking tables (19) for each pair of depositors positioned so that one stacking table cooperates with one depositor (4) of a pair and the other stacking table (19) cooperates with the other depositor (5) of the same pair, a separate compression member (20) provided for each stacking table for pressing work pieces down on the respective stacking table, a separate stack pushing mechanism arranged for each stacking table to horizontally push a stack off the respective stacking table, second conveyor means (23) including two conveyors, one of which is located to receive work piece stacks from one stacking table while the other conveyor is located to receive work piece stacks from the other stacking table as the work piece stacks are pushed off said stacking tables for collecting stacks of work pieces on said second conveyor means from a plurality of said stacking tables, third conveyor means (30,31) for receiving stacks of work pieces from said second conveyor means, and transfer means (35) for transferring work piece stacks from sadi second conveyor means to said third conveyor means, whereby said several columns of work pieces are consolidated into a second number of rows of work piece stacks, said second number being smaller than said first number.

2. The apparatus of claim 1, wherein said second conveyor means are arranged at a right angle to said several columns of stacks, and wherein said third conveyor means form a single row of work pieces.

3. The apparatus of claim 1, wherein said depositors comprise drums with pockets (14) therein for receiving individual work pieces, and means for rotating said drums of a pair of drums in the same direction.

4. The apparatus of claim 1, wherein said depositors comprise drums with pockets (14) therein for receiving individual work pieces, and means for rotating said drums of a pair of drums in opposite directions.

5. The apparatus of claim 1, wherein said branching stations comprise suction drums for picking up individual work pieces for transfer to said depositors.

6. The apparatus of claim 1, wherein said stacking tables comprise a waiting position (39, 40).

* * * * *